US005300928A

United States Patent [19]

Yamazaki

[11] Patent Number: 5,300,928

[45] Date of Patent: Apr. 5, 1994

[54] LIQUID CRYSTAL COLOR DISPLAY DEVICE

[75] Inventor: Shunpei Yamazaki, Tokyo, Japan

[73] Assignee: Semiconductor Energy Laboratory Co., Ltd., Kanagawa, Japan

[21] Appl. No.: 822,914

[22] Filed: Jan. 21, 1992

Related U.S. Application Data

[63] Continuation of Ser. No. 457,964, Dec. 27, 1989, abandoned.

[30] Foreign Application Priority Data

Dec. 27, 1988 [JP] Japan ..... 63-335629
Dec. 27, 1988 [JP] Japan ..... 63-335630

[51] Int. Cl.[5] ..... G09G 3/36; G09G 5/02

[52] U.S. Cl. ..... 345/88; 359/48; 359/68

[58] Field of Search ..... 340/701, 703, 702, 716, 340/784; 359/66, 68, 69; 559/48

[56] References Cited

U.S. PATENT DOCUMENTS 3,569,614 3/1971 Stolov ..... 340/784
4,843,381 6/1989 Baron ..... 340/784
4,892,393 1/1990 Terashima et al. ..... 359/104 OR
4,944,578 7/1990 Denison ..... 340/784

*Primary Examiner*—Jeffery Brier
*Attorney, Agent, or Firm*—Sixbey, Friedman, Leedom & Ferguson

[57] ABSTRACT

A liquid crystal display device comprises a light source, a liquid crystal display cell and a light source liquid crystal cell having color filters, so that the light from the light source passes through the light source liquid crystal cell and the liquid crystal display cell for display wherein the light passing through the color filters in sections turns ON or OFF the liquid crystal at the sections on the color filters in sections at a great speed.

10 Claims, 3 Drawing Sheets

LIQUID CRYSTAL COLOR DISPLAY DEVICE

This is a Continuation application of Ser. No. 07/457,964, filed Dec. 27, 1988 now abandoned.

BACKGROUND OF THE INVENTION

1. Field of the Invention

The present invention relates to a color display device using liquid crystals.

2. Description of the Prior Art

Currently used in the most common method for displaying color in a liquid crystal display are color filters for the three primary colors—red, blue, and green—which are provided for each of the picture elements in a liquid crystal display cell. Specifically, three picture elements are constructed to form one unit, in which the color to be displayed—red, blue, and green—in the respective picture element is predetermined, and, making use of the fact that the human eye is unable to distinguish the respective color elements, the method provides a total color harmony of the three colors in the display through the picture elements. For example, when the color to be displayed is white, the red, blue, and green picture elements are all displayed. Because the human eye is unable to differentiate between the respective three picture elements, the total of the three colors appears as white.

In this method, the color filters are usually provided inside the liquid crystal display cell. This is because, if they were provided on the outside of the liquid crystal display cell, the view would change according to the viewing angle.

This method has some drawbacks that the structure is complicated because one filter is provided for one picture element, that because three picture elements—red, blue, and green—are combined as one unit, the display is rather coarse, and that because the intensity of light for each color must be even, the thickness of the filters is not necessarily uniform, resulting in that the thickness of the liquid crystal layer is uneven.

In the case of TN type liquid crystal a slight variance in the layer thickness has no effect on the display, but in the case of a ferroelectric liquid crystal, even a slight variance in the thickness of the layer will affect the display.

Accordingly, there are existing problems to be solved in conventional liquid crystal display devices with respect to two features of picture quality and simplification of the manufacturing process.

SUMMARY OF THE INVENTION

An object of the present invention is to provide, with due consideration to the drawbacks of such conventional devices, a device for liquid crystal display in color with a high display density and a simple manufacturing method therefore.

This object is achieved in the present invention by the provision of a liquid crystal color display device comprising: a) a light source, b) a liquid crystal display cell comprising a pair of transparent substrates whose inside surfaces are provided with an electrode arrangement in order to define a plurality of pixels and a ferroelectric liquid crystal provided therebetween, and c) a light source liquid crystal cell provided between the light source and the liquid crystal display cell and comprising a pair of transparent substrates, a plurality of color filters for a plurality of colors formed on either of the substrates, a plurality of electrodes which are formed and located in correspondence with said filters respectively and, a ferroelectric liquid crystal provided therebetween.

The operating principles of the liquid crystal color display device of the present invention will now be explained. In the light source liquid crystal cell, the light from the light source passes through the color filters provided on the substrate of the light source liquid crystal cell to filter out a plurality of colors, and impinges on the inside of the substrate closer to the light source. Several different colors are selected cyclically in sequence by turning the liquid crystals ON and OFF such that the first color is displayed exclusively during a period of time from $t_1$ to $t_2$, the second color from $t_2$ to $t_3$, the third color from $t_3$ to $t_4$, returning to the first color from $t_4$ to $t_5$. When the transmitted light exits the cell, it is scattered by the substrate of the light source cell and a uniform light intensity is produced across the entire light source cell. As a result, the light source cell emits various colors repeatedly in sequence. The light from the light source cell impinges on the display cell, and only the necessary color is selected by the ON/-OFF action of the liquid crystals for display.

In the liquid crystal display device of the present invention, for example, each picture element is required to cause the three colors, that is red, blue, and green to be displayed in sequence at a speed faster than the human eye can follow so that the total combination of the three colors is displayed as white. It is also possible, in the same manner, to display only red and blue alternately when a purple display is desired. Accordingly, instead of combining three picture elements as a unit, as is done in the convectional technology, the present invention treats each individual picture element as a unit, so that the density of the display is greatly increased.

It is possible, by application of the present invention, to provide the color filters independent from the liquid crystal display substrate. In addition, any precise fabrication process is no longer necessary to provide color filters for each picture element, as is required in conventional liquid crystal color displays. This is very beneficial for cost reduction.

In addition, the switching of the display cell which must occur at a speed faster than the human eye can follow is achieved by utilizing ferroelectric liquid crystals because ferroelectric liquid crystals can move faster than TN liquid crystals.

BRIEF DESCRIPTION OF THE DRAWINGS

These and other objects, features, and advantages of the present invention will become more apparent from the following description of the preferred embodiments taken in conjunction with the accompanying drawings, in which.

DETAILED DESCRIPTION OF THE PREFERRED EMBODIMENTS

The construction of the liquid crystal display device of the present invention will now be explained with reference to FIG. 1.

Figure 1:
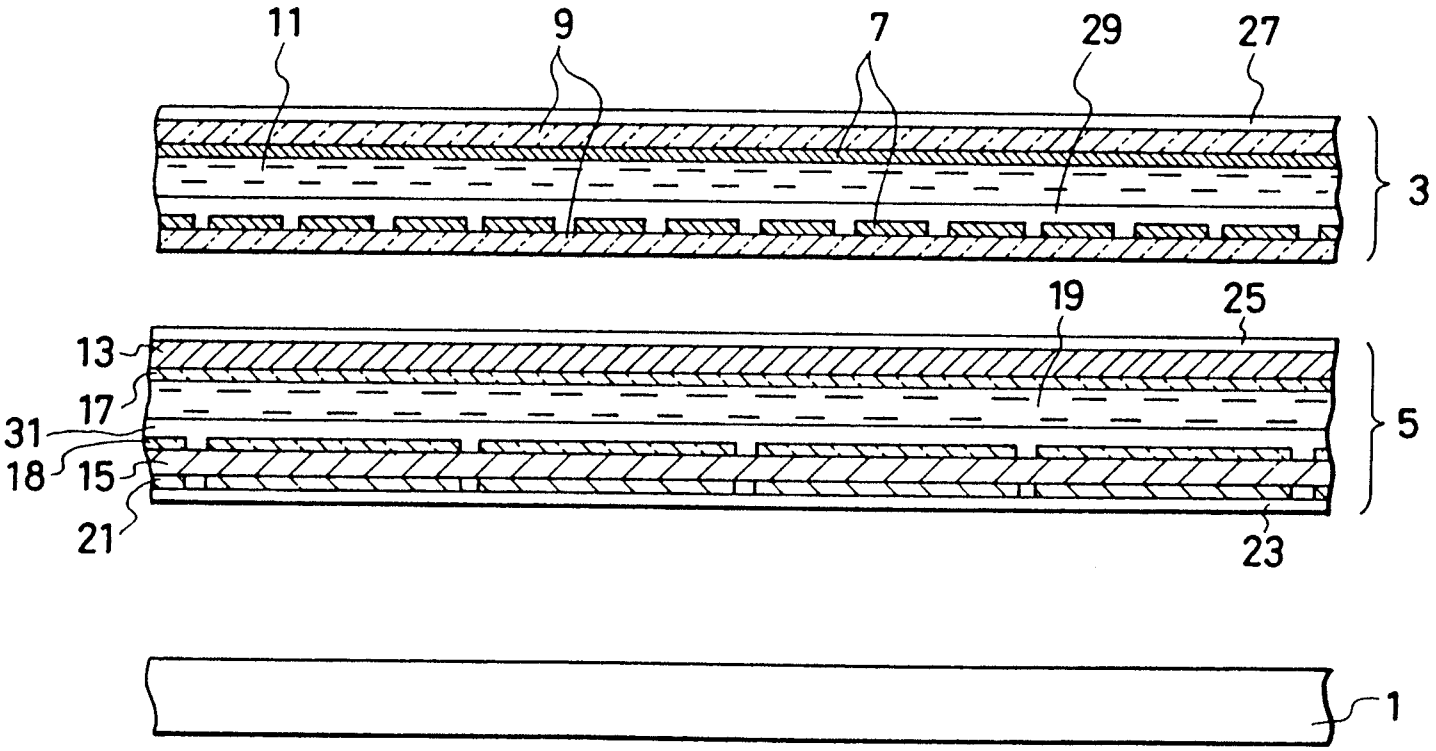
FIG. 1 is a cross-sectional view showing one part of the color liquid crystal display device in one embodiment of the present invention.

Now referring to FIG. 1, a liquid crystal display device comprises a light source 1, a liquid crystal display cell 3 and a light source liquid crystal cell 5. The light from the light source 1 passes through the light source liquid crystal cell 5 and the liquid crystal display cell 3 and is then displayed.

The liquid crystal display cell 3 comprises a pair of transparent substrates 9, a pair of transparent electrodes 7 and a layer of ferroelectric liquid crystal 11, which is constructed in the same way as a usual black and white display device using ferroelectric liquid crystals. The layer of ferroelectric liquid crystal 11 is interposed between the pair of transparent substrates 9 on the inside of which the transparent electrode 7 is formed, respectively.

The light source cell 5 comprises a pair of transparent substrates 13 and 15, a pair of transparent electrodes 17 and 18 formed on the inside of the substrates, a layer of ferroelectric liquid crystals 19 interposed therebetween and a plurality of color filters 21 formed on the bottom of the cell 5. The color filters 21 are formed in a shape of parallel stripes of red, blue, and green color in sequence and the transparent electrode 18 is located in correspondence with the color filters respectively.

A plurality of polarized light means 23, 25 and 27 are also provided in the light source cell 5 and the liquid crystal display cell 3.

Here, it is desirable to have the color filters 21 as close as possible to the liquid crystal, therefore the substrate 15 should be as thin as possible.

The transparent electrodes 17 and 18 for the light source cell 5 may be fabricated in a matrix type, or one of the transparent electrodes 17 and 18 may be formed in a stripe type with the other in a sheet type with no patterning. The transparent electrode 17 or 18 when fabricated in the stripe type may not be fabricated in a very thin width, and made wider in a similar extent from several to several tens of the electrodes for the display cell. The color filters 21 are almost the same in shape as the transparent electrode 17 or 18 fabricated in the stripe type. They may be fabricated through photolithography or printing.

The principle of operation of the color display will be explained hereinafter. The light from the light source 1 is linearly polarized in the polarizing plate 23, then passes through the color filters 21 and reaches the inside of liquid crystal cell 5.

First in the case of displaying a single primary color of green, which is a simple example for explanation, the light passing through blue and red filters is cut off by the polarizing plate 25 by turning OFF the liquid crystal at the sections on the blue and red filters. The light passing through a green filter passes through the polarizing plate 25 by turning ON the liquid crystal at the sections on the green filter. This light is scattered by the substrate 13, and expanded resulting in that the light of a green color impinges uniformly on the liquid crystal display cell 3. Then, only a certain section of the liquid crystal in the display 3 which are turned ON can be displayed in green color.

Red and blue can also be displayed using the same technique as the green mentioned above.

Figure 2:
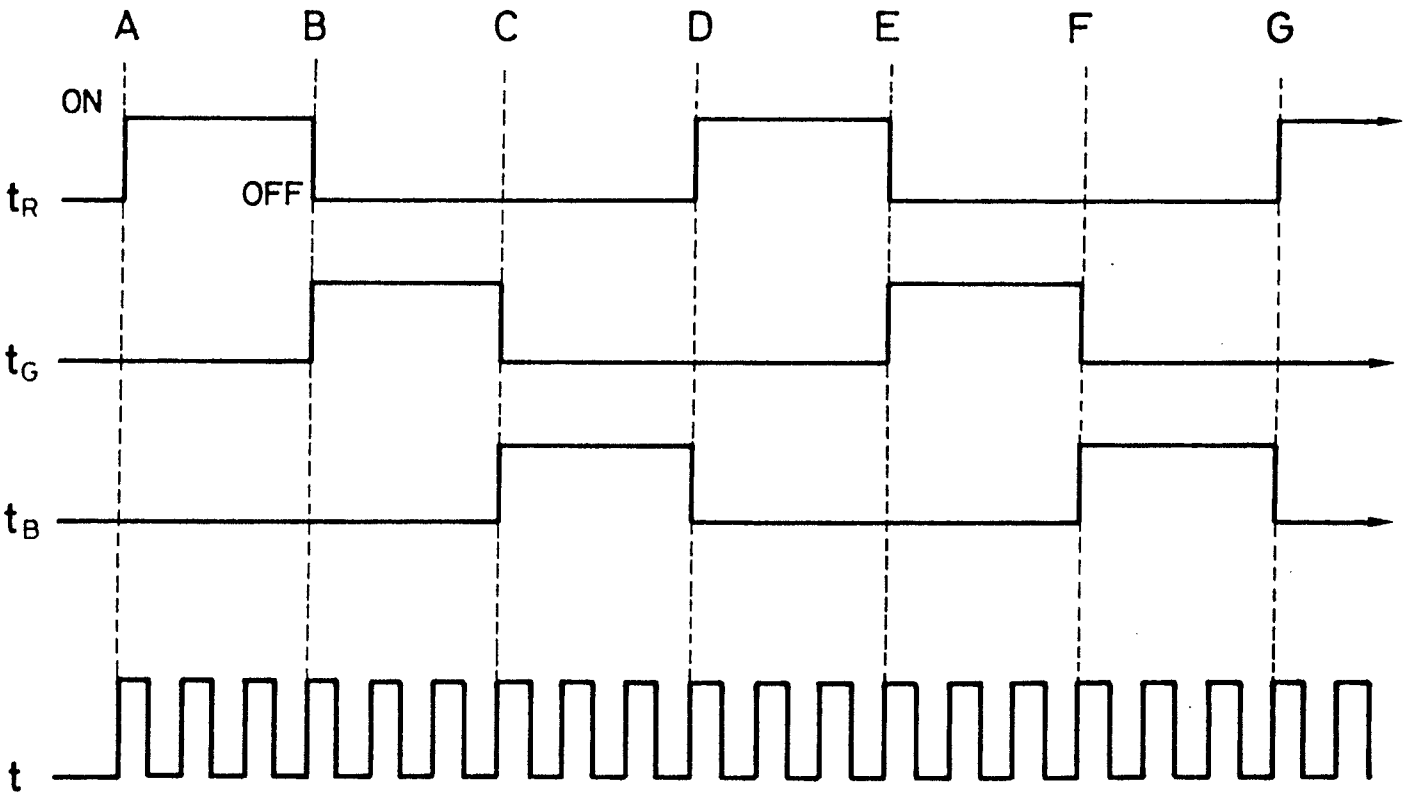
FIG. 2 is a timing chart for explaining the principle of operation of the color display using the liquid crystal color display device in one embodiment of the present invention.
Figure 3:
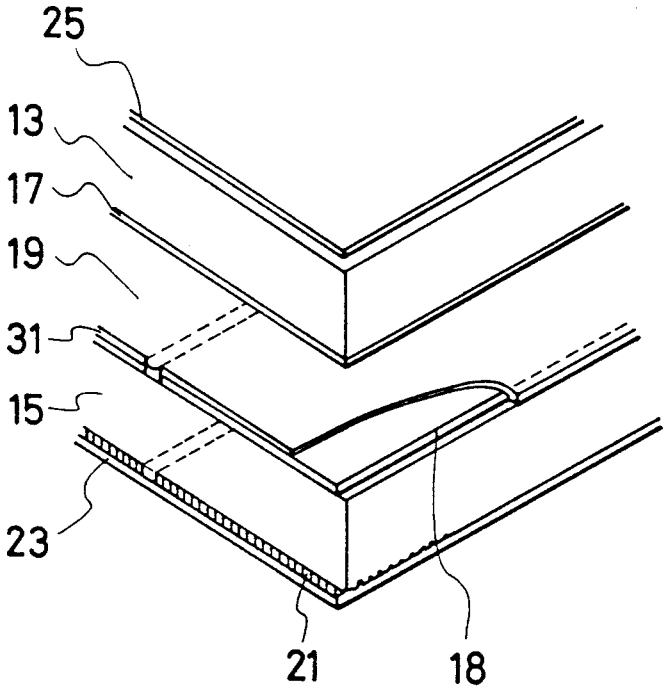
FIG. 3 is a perspective view of a light source cell for the liquid crystal color display device of FIG. 1.

Next, the operation when a certain region in the liquid crystal display cell 3 is to be displayed in white will be explained using the timing chart of FIG. 2. In this chart the abscissa represents time, and $t_R$, $t_G$, and $t_B$ are timing charts for the electric signals which are added to the liquid crystal on each section of the color filters 21 of red, green and blue of the light source cell 5. Also, t is a timing chart for the electric signals which are added to a section of the liquid crystal display cell 3. From time A to B, $t_R$ is ON and only red light impinges uniformly on the surface of the liquid crystal display cell 3. And, $t_G$ is ON and only green light is produced from time B to time C. In the same manner, only blue light is produced from time C to time D. Thereafter this sequence is repeated. In this case, because t is usually in the ON state while synchronous with the electric signal of the light source cell 5, so that red, green, and blue are displayed in sequence on the section of the display screen. This is carried out at a speed faster than the human eye can follow, so the result is a white display which is actually a combination of the three colors.

Following the same principle, when it is desired to display, for example, a color of purple, if t is OFF only during the period from B to C when $t_G$ is ON, red and blue are combined to display purple.

The present invention will be more clearly understood by the following description on embodiments.

EMBODIMENT 1

In FIG. 1, the display cell 3 comprises a pair of substrates 9 of soda glass, a pair of transparent electrodes 7 formed by the ITO through a sputtering method on the substrates 9, and a liquid crystal orientation film 29 formed on one of the transparent electrodes 7.

The display cell 3 was formed through a step of joining the pair of substrates 9. Specifically, after the provision of suitable spacer spraying on the substrates 9, the substrates 9 were joined together with a layer of ferroelectric liquid crystal 11 provided between them. However, the spacer is omitted from the drawings for simplification. The transparent electrode 7 is constructed in a matrix type.

The light source cell 5 comprises a soda glass substrate 13 on which is formed a transparent electrode 17, and a soda glass substrate 15 on which are formed a transparent electrode 18 and an orientation film 31.

The light source cell 5 was formed through a step of joining the pair of substrates 13 and 15. Specifically, the substrates 13 and 15 were joined together with a layer of ferroelectric liquid crystal 19 provided between the substrates 13 and 15. A plurality of color filters 21 were then formed on the outside of the substrate 15. Here, the transparent electrode 17 is constructed to form an electrode generally over one surface without patterning on the surface of the substrate 13 and the transparent electrode 18 is constructed to form an electrode in a stripe type over the other surface of the substrate 15, which has a width larger than the electrode of the display cell 3 (in this embodiment, three times the width of the electrode of the display cell 3) and substantially the same length as that of the electrode 7 of the display cell 3. It is desirable that the thickness of the substrate 13 be greater, so that the light easily scatters and produces a uniform light intensity.

In addition, the polarizing plates 23 and 27 are formed on the outside of the substrates 15 and 9 respectively, and the polarizing plate 25 is formed between the substrates 15 and 9.

The polarizing plate 23 may be provided directly on the light source 1, although the polarizing plate 23 is formed on the bottom of the light source cell 5 in the drawing in this embodiment. In addition, the polarizing plate 25 formed on the light source cell 5 in this embodiment may be provided on the bottom of the display cell 3 in the drawing.

The light passing through the light source cell 5 is scattered by the substrate 13 and is radiated uniformly on the display cell 3. However, when this scattering is weak and the amount of light is not adequate or uniform, a suitable distance may be opened between the two cells 3 and 5 provided that if too much spacing is left, the light will be too weak, therefore about 10 mm or less is adequate. Optionally, it is possible to provide a sheet for scattering the light between the light source cell 5 and the display cell 3.

In this embodiment, red, blue and green required a speed of 10 micron second in writing, respectively.

EMBODIMENT 2

The liquid crystal color display device of this embodiment was fabricated in substantially the same manner as Embodiment 1 except that the light from an overhead projector was used as a light source, resulting in that an extremely clear image was obtained. When a large amount of data is displayed by the OHP, a large amount of transparent film is usually used. However, in this embodiment, different types of displays were obtained with a single display device, so that no transparent film was necessary.

EMBODIMENT 3

Using the device of FIG. 1, many changes were made in the spacing between the light source cell 5 and the display cell 3.

When a display was fabricated with zero spacing, that is, with the two cells 3 and 5 directly joined together, an adequate color display was obtained as in the case where the light source cell 5 was spaced from the display cell 3. Accordingly it is possible to eliminate the substrate 9 on the bottom of the display cell 3 and the substrate 13 on the top of the light source cell 5 in the drawing, and to eliminate a polarizing plate 25 between the substrates 9 and 13, and instead to provide a single substrate made of an organic resin for a common polarizing function purpose.

EMBODIMENT 4

The liquid crystal color display device of this embodiment was fabricated in substantially the same manner as in the display device of FIG. 1 except that the color filters 21 were placed between the substrate 13 and the polarizing plate 25, so that the color filters 21 were sealed to avoid contact with the outside air resulting in that it was possible to obtain an adequate color display and deterioration of the color filters 21 was suppressed.

Although the light source liquid crystal cell 5 and the liquid crystal display cell 3 are used in the foregoing embodiments, only the light source liquid crystal cell 5 may be applied to color illumination. Specifically, although, in the conventional manner, the color filter is selected mechanically for color illumination, in the present invention, liquid crystal switching may be utilized resulting in that the color illumination is performed with low power consumption and at high speed.

The three primary colors are applied in the foregoing explanation, but the present invention should not be limited to the three primary colors for the color filters.

The embodiments used in the embodiments is no way limit the scope of the present invention. It is possible to change the materials and the like used for the polarizing plates and the color filters, and to change the shape of the electrodes and the like as required. The three primary colors are used in the embodiments, but, in principle, more colors can be used.

Also, the reason why a ferroelectric liquid crystal is used in the invention is that its speed of response is very fast. However, the invention is not limited only to ferroelectric liquid crystals. For example, TN liquid crystals can be used in the light source liquid crystal cell when a time-shared driving is not used.

What is claimed is:

1. A liquid crystal light source device comprising:

a pair of substrates;

a liquid crystal layer interposed between said substrates where the pair of substrates and the liquid crystal layer comprise a light source cell, said substrates having inside and outside surfaces, said inside surfaces facing said liquid crystal layer and said outside surfaces located on an outer surface of said substrates other than said inside surfaces;

at least one color filter having a primary color formed on an outside surface of one of said substrates;

an electrode arrangement for applying electric fields to said liquid crystal layer, a light source for projecting a light on an entire surface of said liquid crystal layer through said at least one color filter, wherein said at least one filter faces away from the liquid crystal layer of the light source cell and towards said light source, wherein said light source device is used as a shutter device to control on and off states of light having a primary color or total color harmony of primary colors and wherein said liquid crystal layer includes a ferroelectric liquid crystal layer.

2. The light source device of claim 1, wherein said substrates are light transmissive.

3. The light source device of claim 1, wherein said light source is an overhead projector.

4. A liquid crystal light source device comprising:

a pair of substrates;

a liquid crystal layer interposed between said substrates where the pair of substrates and the liquid crystal layer comprise a light source cell, said substrates having inside and outside surfaces, said inside surfaces facing said liquid crystal layer and said outside surfaces located on an outer surface of said substrates other than said inside surfaces;

a plurality of filters for providing primary colors of red, green, and blue formed on an outside surface of one of said substrates, an electrode arrangement for applying electric fields to said liquid crystal layer, a light source for projecting a light on an entire surface of said liquid crystal layer through said color filters wherein said plurality of filters face away from the liquid crystal layer of the light source cell and towards said light source, wherein an electric field is applied to said liquid crystal layer in order that said light source device projects light and wherein said liquid crystal layer includes a ferroelectric liquid crystal layer.

5. A liquid crystal color display device comprising:

a) a liquid crystal display cell comprising a pair of substrates having an electrode arrangement in a matrix form and a liquid crystal layer interposed between said substrates, said liquid crystal layer being capable of exhibiting a transparent state and a nontransparent state in response to an electric field thereto through said electrode arrangement;

b) a liquid crystal light source cell comprising a pair of substrates having an electrode arrangement, a liquid crystal layer interposed therebetween said substrates having inside and outside surfaces, said inside surfaces facing said liquid crystal layer and said outside surfaces located on an outer surface of said substrates other than said inside surfaces, and a plurality of color filters formed on an outside surface of one of said substrates for providing a plurality of primary colors, wherein said light source cell projects light of said plurality of primary colors in sequence onto said liquid crystal display; and c) a light source for projecting light onto said light source liquid crystal cell, thereby, the light of each of the primary colors is transmitted onto the display device, wherein said liquid crystal display is repeatedly scanned to exhibit images and each scanning of the display corresponds to said primary colors one by one;

and wherein said plurality of color filters are located between said liquid crystal light source cell and said liquid crystal display cell whereby contact of said color filters with air is prevented.

6. The device of claim 5, wherein said light source liquid crystal cell projects onto said liquid crystal display cell light of red, green and blue colors in turn.

7. The device of claim 6, wherein one image is completed by three scans of said display cell, each of said scans corresponding to red, green and blue light, respectively.

8. The device of claim 5, wherein said liquid crystal layer disposed in the light source cell is a ferroelectric liquid crystal layer.

9. The device according to claim 5, wherein said light source is an overhead projector.

10. The device of claim 5, wherein said color filters are on a side of said one of the substrates which faces away from the liquid crystal layer of the light source cell and towards said light source.

* * * * *